US006044589A

United States Patent [19]

Dallos, Jr.

[11] Patent Number: 6,044,589

[45] Date of Patent: Apr. 4, 2000

[54] MOTOR VEHICLE WINDOW MOUNTING APPARATUS

[75] Inventor: Robert Dallos, Jr., Canton, Mich.

[73] Assignee: Saturn Corporation, Troy, Mich.

[21] Appl. No.: 09/396,808

[22] Filed: Sep. 14, 1999

[51] Int. Cl.[7] ..... E05F 11/38

[52] U.S. Cl. ..... 49/375

[58] Field of Search ..... 49/372, 374, 375, 49/348, 349, 350, 351, 501

[56] References Cited

U.S. PATENT DOCUMENTS

| | | | |
|---|---|---|---|
| 4,949,509 | 8/1990 | Gold | 49/375 X |
| 4,987,699 | 1/1991 | Gold | 49/375 |
| 5,050,348 | 9/1991 | Kane et al. | 49/375 X |
| 5,243,785 | 9/1993 | Nieboer et al. | 49/375 |

FOREIGN PATENT DOCUMENTS

| | | | |
|---|---|---|---|
| 0000417 | 1/1983 | Japan | 49/375 |

*Primary Examiner*—Jerry Redman
*Attorney, Agent, or Firm*—Charles E. Leahy

[57] ABSTRACT

A coupling between a motor vehicle window panel and a horizontal sash bar below a lower edge of the window panel including a pair of plastic clips rigidly attached to the window panel which hook onto an edge of the sash bar to vertically couple the window panel to the sash bar with zero vertical lash therebetween and a retainer which audibly signals that the plastic clips are hooked to the sash bar and thereafter prevents dislodgment of the plastic clips from the sash bar. In a preferred embodiment, each plastic clip is adhesively bonded to the window panel and hooks onto a flat edge of the sash bar adjacent to respective ones of a pair of access slots in the flat edge. The retainer includes a cantilever spring on each plastic clip which audibly snaps into a notch in the flat edge of the sash bar when each of the plastic clips are fully hooked on the flat edge of the sash bar and which also thrusts the sash bar and the window panel in opposite directions to eliminate horizontal lash between the sash bar and window panel.

5 Claims, 2 Drawing Sheets

1/2

MOTOR VEHICLE WINDOW MOUNTING APPARATUS

TECHNICAL FIELD

This invention relates to a motor vehicle window mounting apparatus.

BACKGROUND OF THE INVENTION

A motor vehicle typically includes a window opening in a body of the motor vehicle, a window panel, an electric or manual window regulator on the vehicle body, a channel-shaped sash bar connected to the window regulator, and a coupling between the sash bar and the window panel. The window regulator commonly includes a lift arm having a roller at an upper or outboard end thereof and a balance arm pivotally connected to the lift arm in scissors-like fashion and also having a roller at an upper or outboard end thereof The rollers on the lift arm and the balance arm are captured in the channel-shaped sash bar and cooperate in lifting and lowering the sash bar horizontally concurrent with pivotal movement of the lift am The coupling between the window panel and the sash bar typically includes a pair of longitudinally separated plastic clips retained on the window panel at the lower edge thereof through holes in the window panel and two longitudinally separated pairs of hooks on the sash bar. The window panel is manually lowered through the slot at the bottom of the window opening and the hooks are manually slid over the plastic clips for vertical retention of the sash bar on the window panel. The plastic clips, the holes in the window panels, and the two pairs of hooks on the sash bar are manufactured to within close dimensional tolerances to minimize relative movement or "lash" between the window panel and the sash bar after the coupling is completed and are, therefore, significant sources of manufacturing expense. Also, the coupling is difficult to complete reliably and quickly because the lower edge of the window panel and the sash bar are commonly fully or partially concealed below the window opening and no audible signal is emitted when the plastic clips and the hooks are fully united. A coupling according to this invention between a motor vehicle window panel and a sash bar addresses these shortcomings of the above described coupling and is, therefore, an improvement relative thereto.

SUMMARY OF THE INVENTION

This invention is a new and improved coupling between a motor vehicle window panel and a horizontal sash bar below a lower edge of the window panel including a pair of plastic clips rigidly attached to the window panel which hook onto an edge of the sash bar to vertically couple the window panel to the sash bar with zero vertical lash therebetween and a retainer which audibly signals that the plastic clips are hooked to the sash bar and thereafter prevents dislodgment of the plastic clips from the sash bar. In a preferred embodiment, each plastic clip is adhesively bonded to the window panel and hooks onto a flat edge of the sash bar adjacent to respective ones of a pair of access slots in the flat edge. The retainer includes a cantilever spring on each plastic clip which audibly snaps into a notch in the flat edge of the sash bar when each of the plastic clips is fully hooked on the flat edge of the sash bar and which also thrusts the sash bar and the window panel in opposite directions to eliminate horizontal lash between the sash bar and window panel.

DESCRIPTION OF THE PREFERRED EMBODIMENT

Figure 1:
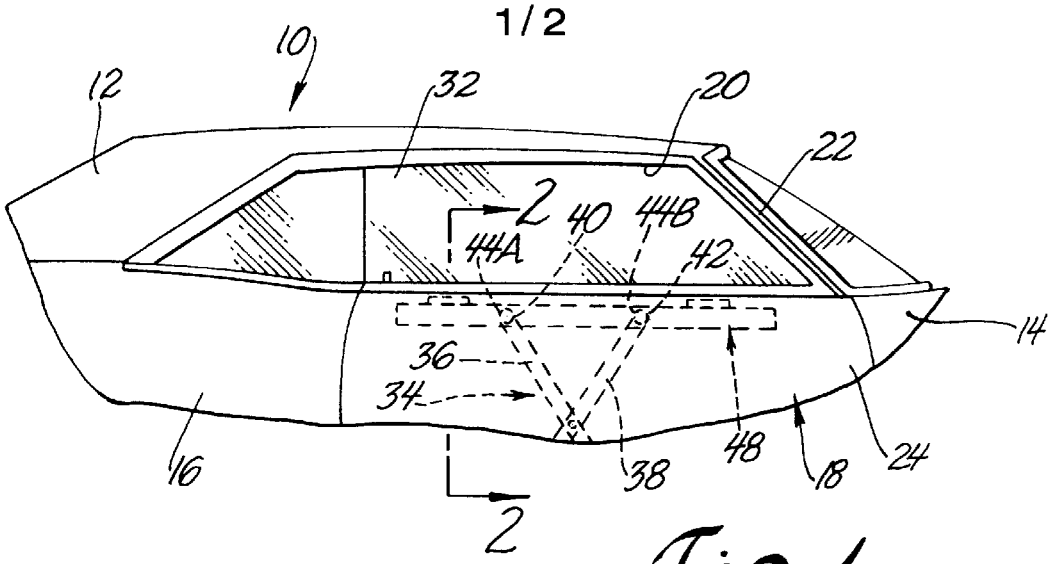
FIG. 1 is a fragmentary elevational view of a motor vehicle body having thereon a window panel coupled to a sash bar by a coupling according to this invention.
Figure 2:
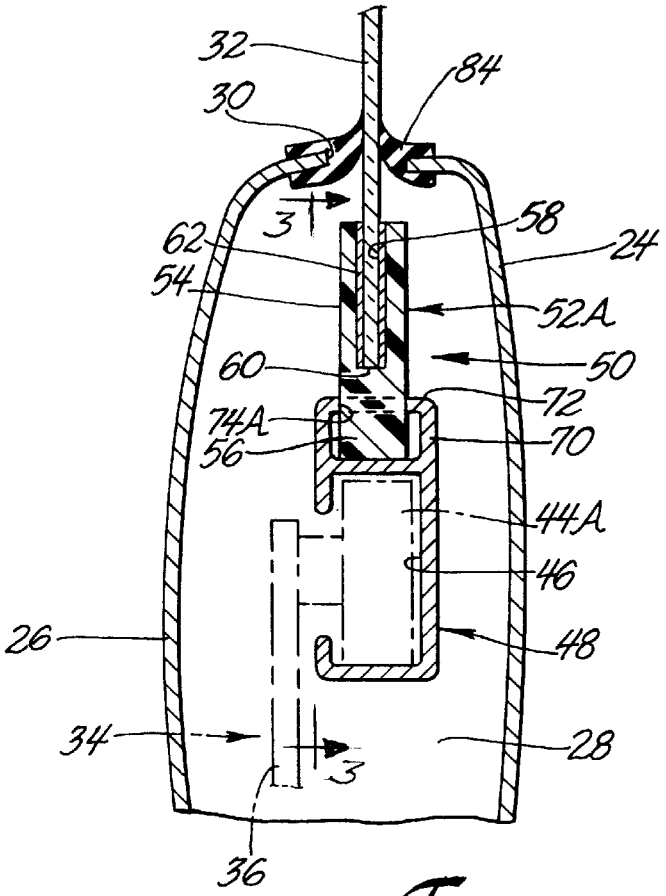
FIG. 2 is an enlarged sectional view taken generally along the plane indicated by lines 2—2 in FIG. 1 showing the coupling according to this invention.

As seen best in FIGS. 1–2, a fragmentarily illustrated motor vehicle body 10 includes a roof 12, a fender 14, and a quarter panel 16. A door 18 is supported on the vehicle body 10 by hinges, not shown, for pivotal movement between a closed position, FIG. 1, flush with the fender and the quarter panel and an open position, not shown. In the closed position of the door, a window opening 20 of the vehicle body is defined behind a pillar 22 thereof and between the roof 12 and the door. The door includes a sheet metal outer panel 24 and a sheet metal inner panel 26 which define therebetween a window well 28 in the door and which converge at the top of the door to define a horizontal slot 30 at the bottom of the window opening 20.

A window panel 32 is supported on the door 18 for vertical linear translation through the horizontal slot 30 between the window opening 20 and the window well 28. A schematically represented electric or manual window regulator 34 in the window well includes a lift arm 36 pivoted up and down by an electric motor or manual crank, not shown, and a balance arm 38 pivotally connected to the lift arm in scissors-like fashion. A lower end, not shown, of the balance arm is guided on the door 18 such that an upper end 40 of the lift arm and an upper end 42 of the balance arm are disposed in a common horizontal plane which translates vertically during up and down pivotal movement of the lift arm.

A pair of rollers 44A,44B are rotatably supported on respective ones of the upper ends 40,42 of the lift arm and the balance arm. The rollers 44A,44B are captured vertically in and roll horizontally in a channel portion 46 of a long sash bar 48 in the window well 28. The rollers 44A,44B thus cooperate with the channel portion 46 in attaching the sash bar horizontally to the window regulator below the slot 30 in the door for vertical linear translation concurrent with pivotal movement of the lift arm. The sash bar 48 is coupled to the window panel 32 by a coupling 50 according to this invention.

Figure 3:
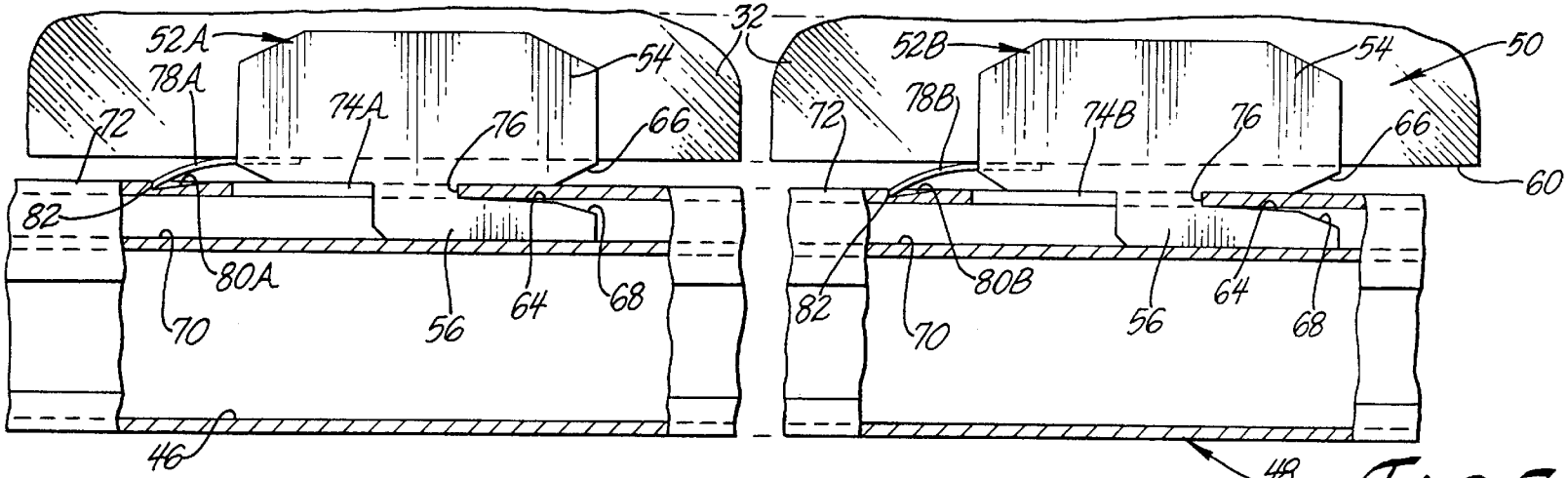
FIG. 3 is an enlarged view taken generally along the plane indicated by lines 3—3 in FIG. 2.
Figure 4:
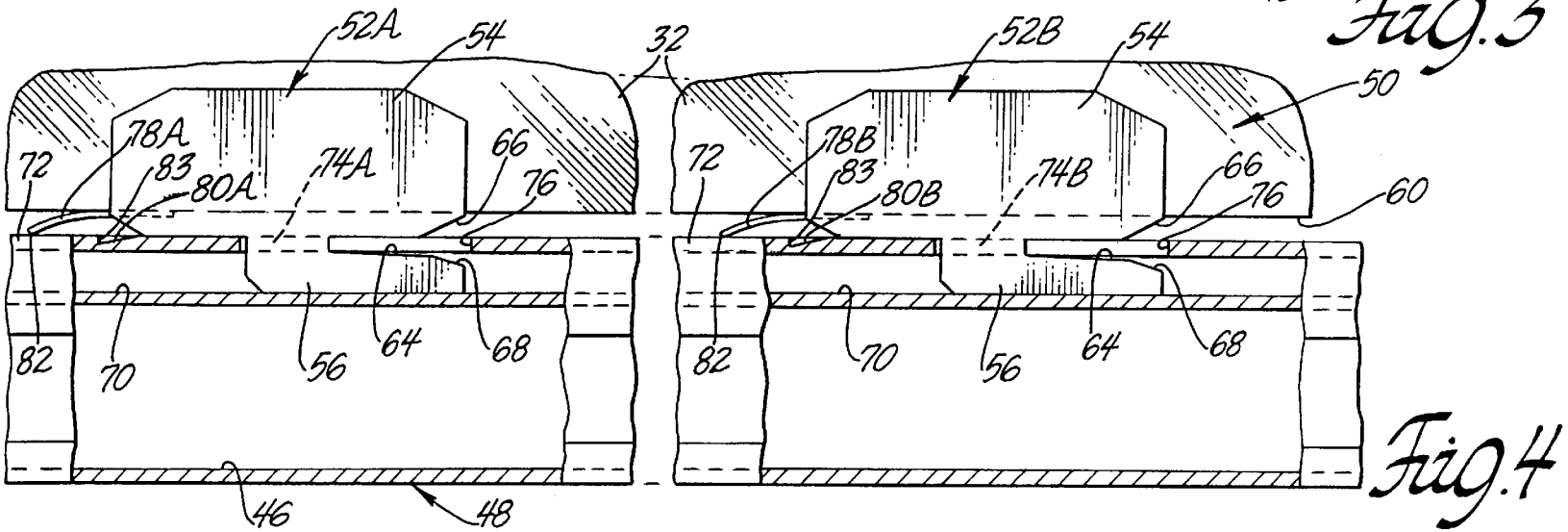
FIG. 4 is similar to FIG. 3 showing structural elements of the coupling according to this invention in different relative positions.

As seen best in FIGS. 2–4, the coupling 50 includes a pair of plastic clips 52A,52B each having an upper body 54 and an integral lower body 56. The upper body 54 of each plastic clip has a vertical slot 58 therein. The plastic clips fit over a lower edge 60 of the window panel to a depth defined by engagement of the lower edge on the bottoms of the vertical slots. An adhesive film 62 rigidly bonds the upper body of each of the plastic clips to the window panel and eliminates lash between the plastic clips and the window panel in every direction. The plastic clips and the window panel may be rigidly fixtured relative to each other before the adhesive film is applied or before it cures for simple but precise alignment of the plastic clips relative to the window panel. However, while adhesive bonding of the plastic clips to the window panel is preferred, other attachment options, e.g. fasteners in holes in the window panel, are within the scope of this invention.

The lower body 56 of each plastic clip 52A,52B is separated from the upper body by a wedge-shaped slot 64, illustrated in exaggerated fashion in FIGS. 3–4, parallel to the lower edge 60 of the window panel whereby each lower body constitutes a hook on the corresponding one of the plastic clips. A beveled shoulder 66 on the upper body faces a beveled shoulder 68 on the lower body of each plastic clip and cooperates therewith in defining a guide at the mouth or open end of the corresponding wedge-shaped slot 64.

The coupling 50 further includes an integral tubular portion 70 of the sash bar above the channel portion 46 having a rectangular cross section and a flat side 72 constituting a flat upper or top edge of the sash bar. The flat side 72 is perforated by a pair of rectangular access slots 74A, 74B. The cross sectional area of the tubular portion 70 of the sash bar exceeds the cross sectional area of the lower bodies 56 of the plastic clips. The longitudinal separation between the access slots corresponds to the longitudinal separation between the plastic clips on the window panel. Each of the access slots has a length and a width dimension suitable for reception of a corresponding one of the lower bodies of the plastic clips.

After the plastic clips 52A,52B are attached to the window panel 32 and the sash bar 48 is connected to the window regulator 34 through the rollers 44A,44B, the window panel is manually coupled to the sash bar by first lowering the window panel through the slot 30 in the door until the lower bodies 56 of the plastic clips seat in the tubular portion 70 of the sash bar through respective ones of the access slots 74A,74B, FIG. 4. The sash bar is then linearly translated parallel to the lower edge 60 of the window panel to slide the flat side 72 of the tubular portion of the sash bar into the wedge-shaped slots 64 until an end 76 of each access slot seats against the bottom of the corresponding one of the wedge-shaped slots, FIG. 3. Alternatively, the window panel may be lowered toward the sash bar at an angle relative thereto with the guides defined by the beveled shoulders 66,68 on the upper and lower bodies of the plastic clips cooperating with the ends 76 of the access slots in guiding the wedge-shaped slots over the flat side of the tubular portion of the sash bar. Importantly, when the ends 76 of the access slots are seated against the bottoms of the wedge-shaped slots, the hooks defined by the lower bodies 56 of the plastic clips are spread resiliently apart to tightly grip the flat side of the tubular portion of the sash bar. The sash bar and the window panel are thus coupled together for unitary vertical linear translation with zero vertical lash therebetween.

The coupling 50 between the sash bar and the window panel further includes a pair of cantilever springs 78A,78B rigidly attached to respective ones of the plastic clips 52A,52B and a pair of notches 80A,80B in the flat side 72 of the tubular portion of the sash bar behind respective ones of the access slots 74A,74B. A distal end 82 of each of the cantilever springs is biased against the flat side 72 of the tubular portion of the sash bar by resilient flexure of the spring. When the sash bar is linearly translated parallel to the lower edge of the window panel to hook the plastic clips onto the sash bar, the distal ends 82 of the cantilever springs slide along the flat side 72 of the sash bar and into the notches 80A,80B concurrent with the ends 76 of the access slots seating on the bottoms of the wedge-shaped slots. The transition of the distal end 82 of each of the springs 78A,78B into the corresponding notch 80A,80B is accompanied by an audible click which signals to the person installing the window panel that the coupling to the sash bar is complete. In addition, the distal end 82 of each cantilever spring resiliently bears against a back shoulder 83, FIG. 4, of the corresponding notch 80A,80B to thrust the window panel and the sash bar in opposite directions parallel to the lower edge of the window panel The ends 76 of the access slots are thereby biased against the bottoms of the wedge-shaped slots 64 to eliminate horizontal lash between the window panel and the sash bar. A seal 84, FIG. 2, is then installed on the door 18 to seal the slot 30 on opposite sides of the window panel.

Having thus described the invention, what is claimed is:

1. A coupling between a motor vehicle window panel and a sash bar below a lower edge of the window panel comprising:

a plastic clip having an upper body and a lower body, an attachment means operative to rigidly attach the upper body of the plastic clip to the window panel over the lower edge of the window panel, a wedge-shaped slot in the plastic clip between the upper body and the lower body thereof parallel to the lower edge of the window panel constituting the lower body a hook on the plastic clip, a flat side on the sash bar constituting an upper edge thereof parallel to the lower edge of the window panel, an access slot in the flat side on the sash bar operative to receive the lower body of the plastic clip, the wedge-shaped slot in the plastic clip slidably receiving the flat side on the sash bar when the sash bar is translated linearly parallel to the lower edge of the window panel and resiliently gripping the flat side on the sash bar to couple the sash bar to the window panel for unitary vertical linear translation with zero vertical lash between the sash bar and the window panel, and a retention means operative in response to linear translation of the sash bar parallel to the lower edge of the window panel to a position in which an end of the access slot seats against a bottom of the wedge-shaped slot corresponding to completion of the coupling between the sash bar and the window panel to automatically prevent dislodgment of the flat side on the sash bar from the wedge-shaped slot and to audibly signal completion of the coupling between the sash bar and the window panel.

2. The coupling between a motor vehicle window panel and a sash bar below a lower edge of the window panel recited in claim 1 wherein:

the retention means is further operative to resiliently bias the end of the access slot against the bottom of the wedge-shaped slot thereby to eliminate lash between the window panel and the sash bar parallel to the sash bar.

3. The coupling between a motor vehicle window panel and a sash bar below a lower edge of the window panel recited in claim 2 wherein the attachment means operative to rigidly attach the upper body of the plastic clip to the window panel over the lower edge of the window panel comprises:

a vertical slot in the upper body of the plastic clip around the lower edge of the window panel, and an adhesive film between the vertical slot in the plastic clip and the window panel.

4. The coupling between a motor vehicle window panel and a sash bar below a lower edge of the window panel recited in claim 2 wherein the retention means comprises:

a notch in the flat side on the sash bar, and a cantilever spring on the plastic clip having a distal end resiliently biased against the flat side on the sash bar and audibly snapping into the notch in the flat side of the sash bar against a shoulder of the notch when the end of the access slot seats against the bottom of the wedge-shaped slot.

5. The coupling between a motor vehicle window panel and a sash bar below a lower edge of the window panel recited in claim 3 wherein the retention means comprises:

a notch in the flat side on the sash bar, and a cantilever spring on the plastic clip having a distal end resiliently biased against the flat side on the sash bar and audibly snapping into the notch in the flat side on the sash bar against a shoulder of the notch when the end of the access slot seats against the bottom of the wedge-shaped slot.

* * * * *